United States Patent [19]

Feniello

[11] Patent Number: 4,967,925

[45] Date of Patent: Nov. 6, 1990

[54] TABLE-TOP GAME CONTAINER OR THE LIKE

[75] Inventor: Paul E. Feniello, Dunwoody, Ga.

[73] Assignee: AIG Trade Corp., Roswell, Ga.

[21] Appl. No.: 383,020

[22] Filed: Jul. 19, 1989

[51] Int. Cl.[5] ..... B65D 57/00

[52] U.S. Cl. ..... 220/22; 273/287

[58] Field of Search ..... 273/287, 3 R, 3 C, 4 R; 220/22; 108/117, 119, 118

[56] References Cited

U.S. PATENT DOCUMENTS

| | | | |
|---|---|---|---|
| 150,735 | 5/1874 | Whitcomb | 273/287 |
| 352,555 | 11/1886 | Merkel | 108/119 |
| 559,743 | 5/1896 | Ormsby | 108/118 |
| 716,435 | 12/1902 | Lackner | 273/287 |
| 1,348,262 | 8/1920 | Brockway | 273/287 |
| 1,412,314 | 4/1922 | Pandolfo | 108/119 |
| 2,292,016 | 8/1942 | Scovil | 273/287 |
| 3,792,186 | 2/1974 | Principe | 273/287 |
| 3,981,503 | 9/1976 | Tsukuda | 273/287 |
| 4,015,778 | 4/1977 | Chen et al. | 273/287 |
| 4,513,974 | 4/1985 | Lin | 273/287 |

*Primary Examiner*—Stephen Marcus
*Assistant Examiner*—Stephen Castellano
*Attorney, Agent, or Firm*—Hopgood, Calimafde, Kalil, Blaustein & Judlowe

[57] ABSTRACT

The invention in a preferred embodiment contemplates a table-top game container construction comprising a generally rectangular-prismatic body frame of four outer walls of relatively shallow vertical height compared to the length and width dimensions of the container. Two spaced inner walls extend for the width dimension parallel to each other and to the respective longitudinal limits of the frame walls. The inner walls divide the length dimension into a central game-board supporting area in the space between the inner walls, and into separate game-piece compartments at each of the longitudinal ends of the body frame. A separate closure panel is provided for each of the game-piece compartments, and each closure panel is selectively operable to open and close its game-piece compartment for access via the general plane of the playing surface of the game board and to one side of the playing surface. Articulated collapsible leg structure connected to the underside of the container enables the structure selectively to provide a horizontal game-table surface, or, when in collapsed condition to enable vertically oriented storage wherein the game-piece compartments are gravitationally retained in closed condition.

12 Claims, 2 Drawing Sheets

TABLE-TOP GAME CONTAINER OR THE LIKE

BACKGROUND OF THE INVENTION

The invention relates to a gaming container suited for table-top support of a game-board panel and with self-contained provision for storage and retention of game pieces. More particularly, the invention relates to such a container having its own articulated supporting legs which provide correct table-height horizontal support of the container when in use, said legs being collapsible beneath said container for compact storage when not in use.

Game boards for such table-top contests as the games of chess, checkers, and backgammon are customarily made of hinged panels to be opened and laid flat on a supporting table surface, and game pieces such as chessmen are customarily housed in a separate container selectively openable as via a slidable closure panel.

Game furniture is known wherein a given game-board pattern, such as the patterned squares of a chess board or the patterned triangles of a backgammon board, are committed, as for example by inlays, into the permanent structure of the article of furniture.

So-called TV-tray furniture is known wherein a system of hingedly articulated legs enables a tray to be supported as a temporary table by crossed pairs of legs or, alternatively, to be collapsed by folding the legs to the bottom of the tray, for compact vertical storage of the tray when not in use.

BRIEF DESCRIPTION OF THE INVENTION

It is an object of the invention to provide an improved game-board construction wherein provision is made for selective access to one or more game-piece components integrally formed with the game-board structure or with supporting means for selective accommodation of a particular one of several alternative game-board panel surfaces.

A specific object is to provide such a construction with selective access to the one or more game-piece compartments alongside and virtually via the same horizontal plane as the playing surface of the game-board when in use.

Another specific object is to provide collapsible supporting-leg structure for the game-board structure, whereby the game-board construction may be stowed with its collapsed leg structure in a substantially vertical orientation wherein closure of the one or more game-piece compartments is gravitationally retained when the game-board and leg structures are in collapsed and vertically oriented stowed condition.

The invention in a preferred embodiment achieves these objects in a table-top game container construction comprising a generally rectangular-prismatic body frame of four outer walls of relatively shallow vertical height compared to the length and width dimensions of the container. Two spaced inner walls extend for the width dimension parallel to each other and to the respective longitudinal limits of the frame walls. The inner walls divide the length dimension into a central game-board supporting area in the space between the inner walls, and into separate game-piece compartments at each of the longitudinal ends of the body frame. A separate closure panel is provided for each of the game-piece compartments, and each closure panel is selectively operable to open and close its game-piece compartment for access via the general plane of the playing surface of the game board and to one side of the playing surface. Articulated collapsible leg structure connected to the underside of the container enables the structure selectively to provide a horizontal game-table surface, or, when in collapsed condition to enable vertically oriented storage wherein the game-piece compartments are gravitationally retained in closed condition.

DETAILED DESCRIPTION

The invention will be described in detail for a preferred embodiment, in conjunction with the accompanying drawings, in which.

Figure 2:
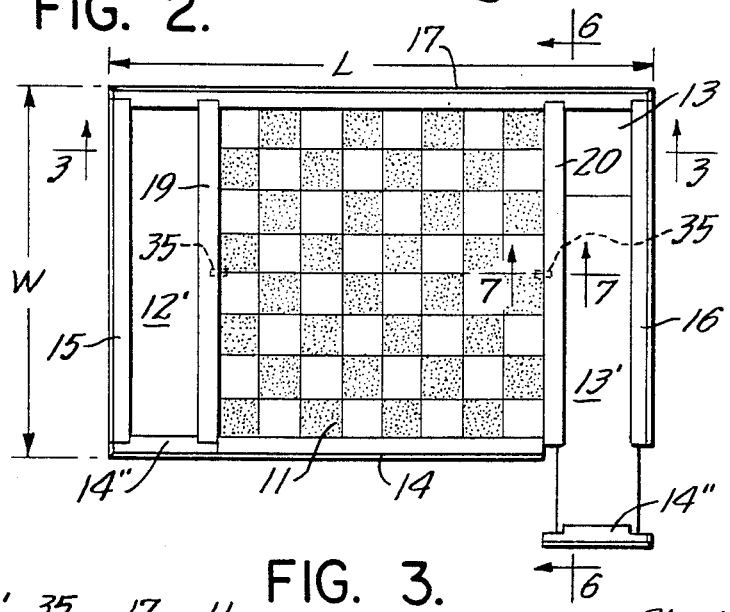
FIG. 2 is a plan view of the game table of FIG. 1.
Figure 3:
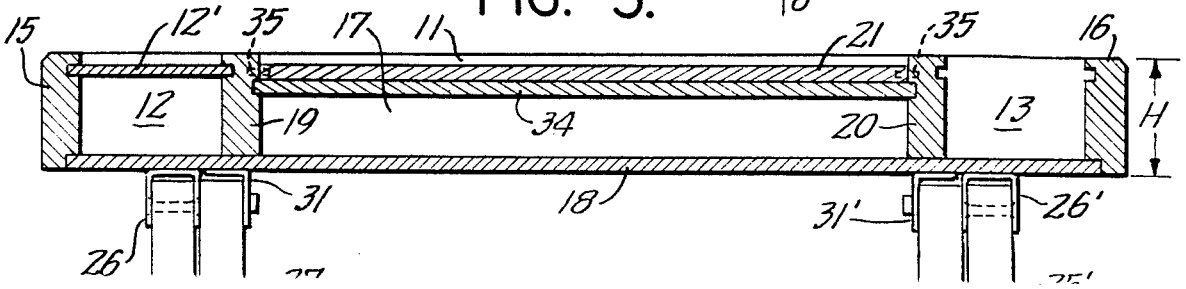
FIG. 3 is an enlarged vertical section, taken at 3—3 of FIG. 2.
Figure 6:
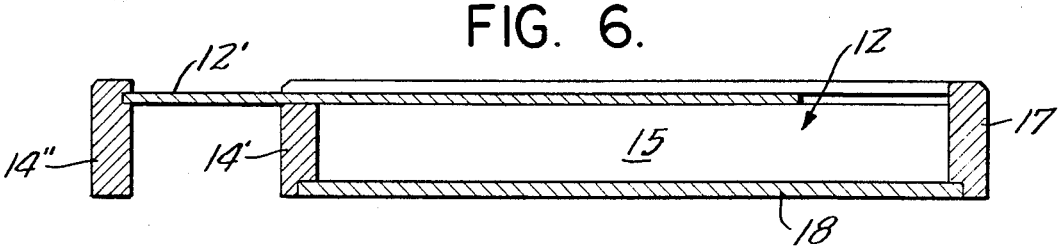
Figure 7:
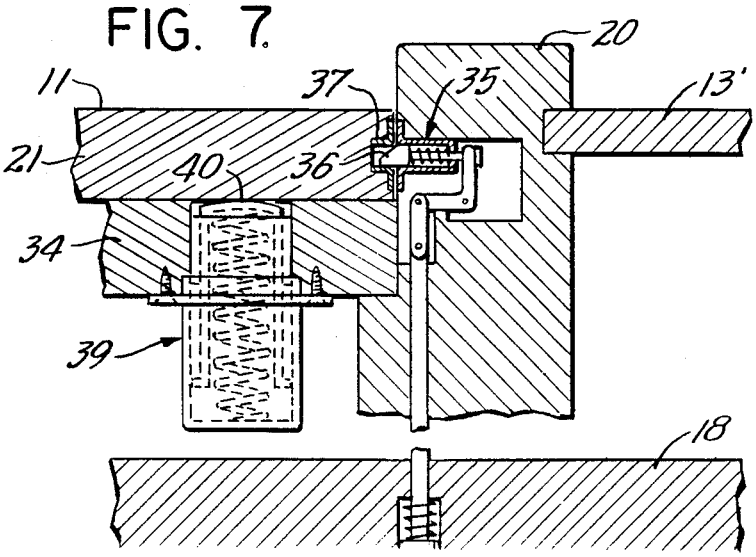

FIG. 6 is a vertical section taken at the plane identified 6—6 in FIGS. 2 and 3; and FIG. 7 is a simplified and enlarged fragmentary view in vertical section, taken in the plane 7—7 of FIG. 2.

Figure 1:
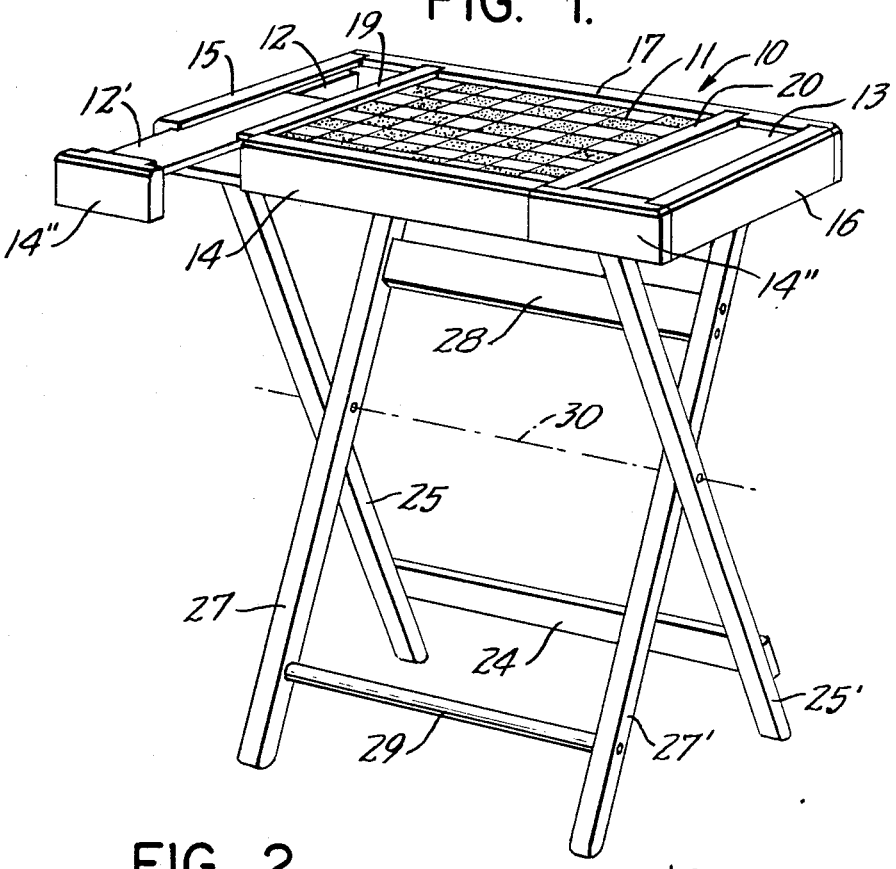
FIG. 1 is a front three-quarter perspective view of a game-table construction of the invention, in readiness for use and with a game-piece compartment closure in partly open condition.

Referring initially to FIGS. 1 to 3, the invention is shown in application to a table-top game container 10 having a generally rectangular-prismatic body frame of relatively shallow vertical height H compared to its horizontal length L and width W. A gaming-board surface, such as the chess or checkers board surface 11, is framed at the longitudinally central region of the length dimension L, and the longitudinally outer end regions of the body frame feature separate game-piece compartments 12/13 which are selectively accessible alongside, and via the geometric plane of, the gaming-board surface 11. Access to the respective compartments 12/13 is via selectively operable closure panels 12'/13', each of which is slidable outwardly of the same longitudinal side-wall element 14 of the body frame; FIG. 3 shows guide grooves for panels 12'/13' in opposed surfaces of wall members 15/19 and 16/20.

More specifically, the body frame is shown to comprise upstanding outer walls 15/16 at the respective ends of the length dimension, and a connecting wall 17 parallel to the front-wall element 14. Adjacent ends of walls 15/16/17 are connected to each other, and a bottom panel 18 is shown (FIGS. 3 and 6) to have connection to the rabbeted lower edges of walls 15/16/17.

Preferably, for greater structural integrity, the outer-wall element 14 is primarily a decorative panel that is attached to a framing-wall member 14' (See FIG. 6) which extends the full length L of the table-top structure. Spaced inner walls 19/20, parallel to end walls 15/16, span the width dimension W, connecting the longitudinal walls 14'/17 and rising from bottom panel 18 to the same vertical height as the outer walls; these inner walls 9/20 define a square frame within which to support a game-board panel 21 having the game surface 11. For cosmetic purposes, the outer-wall element 14 has the sectional contour and chamfered upper edge of the other framing wall members 15/16/17. The apparent framing is cosmetically completed by separate outer wall elements, conforming to the sectional profile of wall element 14 but connected to the front edge of each of the closure panels 12'/13', as shown in FIG. 6. When the 12'/13' are in closed position, the wall elements 14 and 14" present the appearance of a continuous outer front longitudinal wall, except for the thin-line mark of discontinuity between these front elements.

Figure 4:
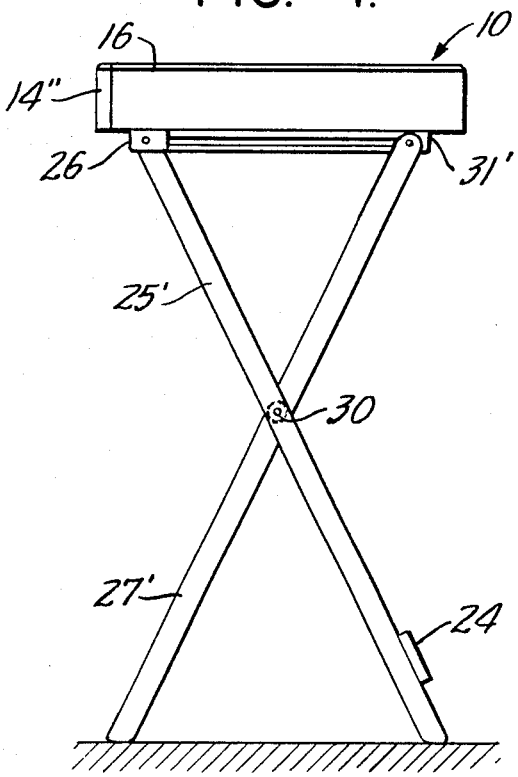
FIGS. 4 and 5 are views in side elevation of the construction of FIG. 1, respectively taken for the erected condition of game-readiness and for the collapsed condition for storage.
Figure 5:
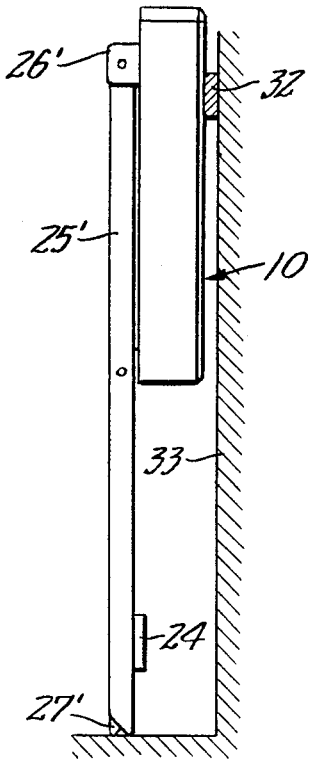

For elevated support of the described table-top game container, a first two longitudinally spaced legs 25/25' are connected to each other via a tie piece 24 and are pivotally connected via brackets 26/26' to the bottom panel 18, and near the front longitudinal framing wall member 14'. And a rigid frame comprising a second two longitudinally spaced legs 27/27', connected by upper and lower spacers 28/29 is pivotally connected to the first two legs on a single axis 30 of pivotal articulation. FIG. 4 shows that in the upright position of game-readiness, the pairs of legs spread, with each of the legs 27/27' engaged to a stop at the end of a slot in one of two guide flanges 31/31' on the bottom panel 18, the stop being near the rear longitudinal frame wall. FIG. 5 shows the collapsed condition of the articulated legs, wherein the table-top container 10 is vertically suspended from brackets 26/26' connection to legs 25/25', the same being shown in a stowed condition, as by leaning against the rub strip 32 of a closet wall 33.

Returning to the table-top structure 10 per se, a preference is indicated for use of an elevated support panel 34 retained by walls 14'/17/19/20 at such vertical offset below the upper edge of the framing members as to permit reception of an inserted game board 21 with a small framing projection above the playing surface 11 of the game board 21. This small projection serves a retaining function against accidental loss of a game piece from the surface 11.

For purposes of retaining a game board in application to the support panel, separate latching devices 35 are suggested in FIG. 3 but are shown in detail for a single latch in FIG. 7. Specifically, a latch bolt 36 is normally spring-urged into retaining engagement with the aperture of a strike plate 37 in the edge of the game board 21, the projecting end of bolt 36 having a cam slope to permit retraction in the course of placing the game board 21 into its position of support on panel 34. Actuating linkage such as push-button operated means 38 is exposed on the underside of bottom panel 18, for selective retraction of bolt 36 and, thus, release of the latched engagement. To facilitate withdrawal of the game board, once released, a spring-loaded button assembly 39 carried by support panel 34 is operative to sufficiently raise an edge of board 21, for finger engagement; the button 40 of assembly 39 will be understood to have been engaged by board 21 and to have been depressed against vertically upward spring action, upon insertion of the game board to its latched position.

The described construction will be understood to meet all stated objects and to provide for convenient storage and use for each of a variety of game boards. Thus, board 21 may have the chess-board pattern on one side, and a backgammon pattern on the reverse side; alternatively, the reverse side may be without pattern, thus enabling games other than those indicated to be played on an unstructured surface.

What is claimed is:

1. A table-top game container, comprising a generally rectangular-prismatic body frame of four outer walls of relatively shallow vertical height compared to its horizontal length and width dimensions, a bottom panel connected to the lower region of said outer walls, at least one vertical inner wall extending for the width dimension and parallel to one of the longitudinal limits of said frame, said inner wall dividing the length dimension into a game-board area on one side of said inner wall and into a game-piece compartment on the other side of said inner wall, a game-board panel removably supported by at least some of the walls of said frame and by said inner wall at vertical offset above said bottom panel, a closure panel coacting with the upper region of walls defining said game-piece compartment, said closure panel being selectively operable to open and closed said game-piece compartment for upwardly open access thereto, and means including latch mechanism coacting between said game-board panel and at least one wall portion adjacent thereto for selective latch retention of game-board support.

2. The game container of claim 1, in which said closure panel is rectangular and elongate in the width dimension of said frame and has slidably guided relation with said inner wall and with the frame wall which confronts the inner wall across the game-piece compartment.

3. The game container of claim 1, in which a support panel is secured to walls of said frame and to said inner wall at vertical offset from said bottom panel, said game-board panel being removably supported by said support panel, and said game-board panel being selectively removable from support-panel engagement.

4. A table-top game container, comprising a general rectangular-prismatic body frame of four frame walls of relatively shallow vertical height compared to its horizontal length and width dimensions, a bottom panel connected to the lower region of said outer walls, two spaced inner walls extending for the width dimension parallel to each other and to the respective longitudinal limits of said body frame, said inner walls dividing the length dimension into a central game-board area in the space between said inner walls and into a separate game-piece compartment at each of the longitudinal ends of said body frame, a game-board panel removably supported by walls of said compartment at vertical offset from said bottom panel, said game-board panel being supported by the spaced inner walls and by the spaced frame walls which define the game-board area, a separate closure panel for each of said game-piece compartments, each closure panel being selectively operable to open and close its game-piece compartment for upwardly open access thereto; and means including latch mechanism coacting between said game-board panel and at least one wall portion adjacent thereto for selective latch retention of game-board support.

5. The game container of claim 4, in which each of said closure panels is rectangular and elongate in the width dimension of said frame and has slidably guided relation with the parallel inner wall and with the frame wall which define the involved game-piece compartment.

6. The game container of claim 4, in which means of support for said game-board panel comprises a support panel secured to wall of said frame and to said inner walls at vertical offset from said bottom panel, said game-board panel being selectively removable from support-panel engagement.

7. The game container of claim 3 or claim 6, in which the thickness of said game-board panel is such, in conjunction with a vertical offset of said support panel beneath upper limits of walls to which said support panel is connected, that when said game-board panel is in supported engagement with said support panel, said upper wall limits define a retaining ledge against loss of game pieces from said game-board panel.

8. The game container of claim 2, in which one of said longitudinal walls is of multiple parts, there being a removable part connected to said closure panel and at least coextensive with the width of said closure panel and serving as a manual means of engaging and actuating said closure panel.

9. The game container of claim 5, in which one of said longitudinal walls is of multiple parts, there being a separate removable part connected to each said closure panel and at least coextensive with the width of said closure panel and serving as a manual means of engaging and actuating the involved closure panel.

10. The game container of claim 1 or claim 4, and means including a spring compressionally loaded against the underside of said game-board panel when in latched position for incrementally raising said game-board panel upon release of said latched engagement.

11. The game container of claim 1 or claim 4, in which a first two spaced legs are hingedly connected to said bottom panel at longitudinally spaced locations near one of said longitudinal frame walls, and in which a second two spaced legs are centrally pivoted to the respective legs of said first two and are selectively collapsible in one position alongside the legs of said first two and, in a second position are engageable to said bottom panel at longitudinally spaced locations near the other of said longitudinal frame walls.

12. The game container of claim 1 or claim 4, in which a first two spaced legs are hingedly connected to said bottom panel at longitudinally spaced locations near one of said longitudinal frame walls, and in which a second two spaced legs are centrally pivoted to the respective legs of said first two and are selectively collapsible in one position alongside the legs of said first two and, in a second position are engageable to said bottom panel at longitudinally spaced locations near the other of said longitudinal frame walls, said closure panel for at least one game-piece compartment being rectangular and elongate in the width dimension of said frame and having slidably guided-relation with the inner and outer walls which defined said at least one game-piece compartment, said closure panel being slidably removable only via said one longitudinal frame wall, whereby with said legs collapsed in said one position and said legs folded against said bottom panel via said hinged connection, said container may lie substantially flat and vertically oriented when not in use and stowed leaning against a storage wall or the like, with said closure panel gravitationally retained in its closed position.

* * * * *